US008599042B2

(12) United States Patent
Lee

(10) Patent No.: US 8,599,042 B2
(45) Date of Patent: Dec. 3, 2013

(54) SIGNAL INFORMATION TRANSMITTING DEVICES AND SIGNAL INFORMATION TRANSMITTING METHODS

(75) Inventor: Seok-Jin Lee, Daegu (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 145 days.

(21) Appl. No.: 13/347,045

(22) Filed: Jan. 10, 2012

(65) Prior Publication Data

US 2012/0182158 A1 Jul. 19, 2012

(30) Foreign Application Priority Data

Jan. 17, 2011 (KR) ..... 10-2011-0004613

(51) Int. Cl.
*G08G 1/097* (2006.01)

(52) U.S. Cl.
USPC ..... 340/907; 340/931

(58) Field of Classification Search
USPC ..... 340/907, 931; 307/46, 66
See application file for complete search history.

(56) References Cited

U.S. PATENT DOCUMENTS

| | | | | |
|---|---|---|---|---|
| 4,255,738 | A * | 3/1981 | Van Tol | 340/931 |
| 7,347,175 | B2 * | 3/2008 | Lupo et al. | 123/179.4 |
| 2009/0302681 | A1 * | 12/2009 | Yamada et al. | 307/46 |
| 2011/0121654 | A1 * | 5/2011 | Recker et al. | 307/66 |

FOREIGN PATENT DOCUMENTS

| | | |
|---|---|---|
| KR | 1998-0004221 | 3/1998 |
| KR | 20-1996-0058497 | 9/1998 |
| KR | 10-0888944 | 3/2009 |
| KR | 10-2010-0032036 | 3/2010 |

* cited by examiner

*Primary Examiner* — John A Tweel, Jr.
(74) *Attorney, Agent, or Firm* — Staas & Halsey LLP

(57) ABSTRACT

Provided are a signal information transmitting device and a signal information transmitting method. The method includes detecting sections for which current flows through signal lines of a target device and generating detect signals according to the current flow detection result; detecting sections for which switches are turned on and generating switch signals according to the switch detection result; mapping the detect signals with the switch signals according to overlapping sections between active sections of the detect signals and active sections of the switch signals; and transmitting information on the detect signals according to the mapping result.

12 Claims, 12 Drawing Sheets

SIGNAL INFORMATION TRANSMITTING DEVICES AND SIGNAL INFORMATION TRANSMITTING METHODS

CROSS-REFERENCE TO RELATED APPLICATIONS

This U.S. non-provisional patent application claims priority under 35 U.S.C. §119 of Korean Patent Application No. 10-2011-0004613, filed on Jan. 17, 2011, the entire contents of which are hereby incorporated by reference.

BACKGROUND OF THE INVENTION

The present invention disclosed herein relates to a signal information transmitting device and a signal information transmitting method.

A car having an Electronic Control Unit (ECU) is driven according to a control of the ECU. Exemplarily, the car may control a fuel injection amount, front wheel and rear wheel brakes, and front wheel and rear wheel driving powers according to a control of the ECU. Additionally, the car may control whether to drive the engine according to a control of the ECU. For example, when the car waits for a traffic light, the engine of the car may be stopped according to a control of the ECU. Also, when the car starts, the engine of the car may be driven according to a control of the ECU.

According to the timings that the ECU stops and drives the engine, the fuel consumption efficiency and operating performance of the car may be changed. For example, as a time until the engine stops after the car stops is longer, the fuel consumption efficiency of the car is decreased. Moreover, as a time until the engine starts after a start signal is turned on is shorter, the operating performance of the car is increased. That is, when the ECU of the car is synchronized to a signal switching timing of a traffic light, the fuel consumption efficiency and operating performance of the car may be optimized.

SUMMARY OF THE INVENTION

The present invention provides a signal information transmitting device communicated with a traffic light to perform a signal information transmitting function and a signal information transmitting method.

Embodiments of the present invention provide signal information transmitting methods including: detecting sections for which current flows through signal lines of a target device and generating detect signals according to the current flow detection result; detecting sections for which switches are turned on and generating switch signals according to the switch detection result; mapping the detect signals with the switch signals according to overlapping sections between active sections of the detect signals and active sections of the switch signals; and transmitting information on the detect signals according to the mapping result.

In some embodiments, the mapping of the detect signals with the switch signals may include mapping a switch signal with a specific detect signal in response to switch signals generated during a learning mode, the switch signal having the longest overlapping active section with an active section of the specific detect signal.

In other embodiments, the transmitting of the detect signals may include transmitting information regarding an active section of a detect signal mapped with a specific switch signal.

In still other embodiments, the transmitting of the information on the detect signals may include transmitting an error message when the mapped detect signal is not activated during an active section thereof.

In even other embodiments, the signal information transmitting methods may further include transmitting position information.

In yet other embodiments, the target device may include a traffic light.

In further embodiments, the signal lines may be control lines controlling lamps of the traffic light.

In other embodiments of the present invention, signal information transmitting devices include: a plurality of current detectors configured to activate detect signals according to whether current is detected or not; a plurality of switches configured to activate switch signals when turned on; and a signal processing unit configured to map the detect signals with the switch signals during a learning mode, wherein the signal processing unit transmits information on the detect signals according to the mapping result during an operating mode.

In some embodiments, the signal processing unit may map a switch signal with a specific detect signal during the learning mode, the switching signal having the longest overlapping active section with an active section of the specific detect signal.

In other embodiments, the signal processing unit may transmit information regarding an active section of a detect signal mapped with the specific switch signal during the operating mode.

In still other embodiments, the signal processing unit may output an error message when the mapped detect signal is not activated in an active section thereof during the operating mode.

In even other embodiments, the signal processing unit may further transmit position information during the operating mode.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Preferred embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art.

Hereinafter, it will be described about an exemplary embodiment of the present invention in conjunction with the accompanying drawings.

Figure 1:
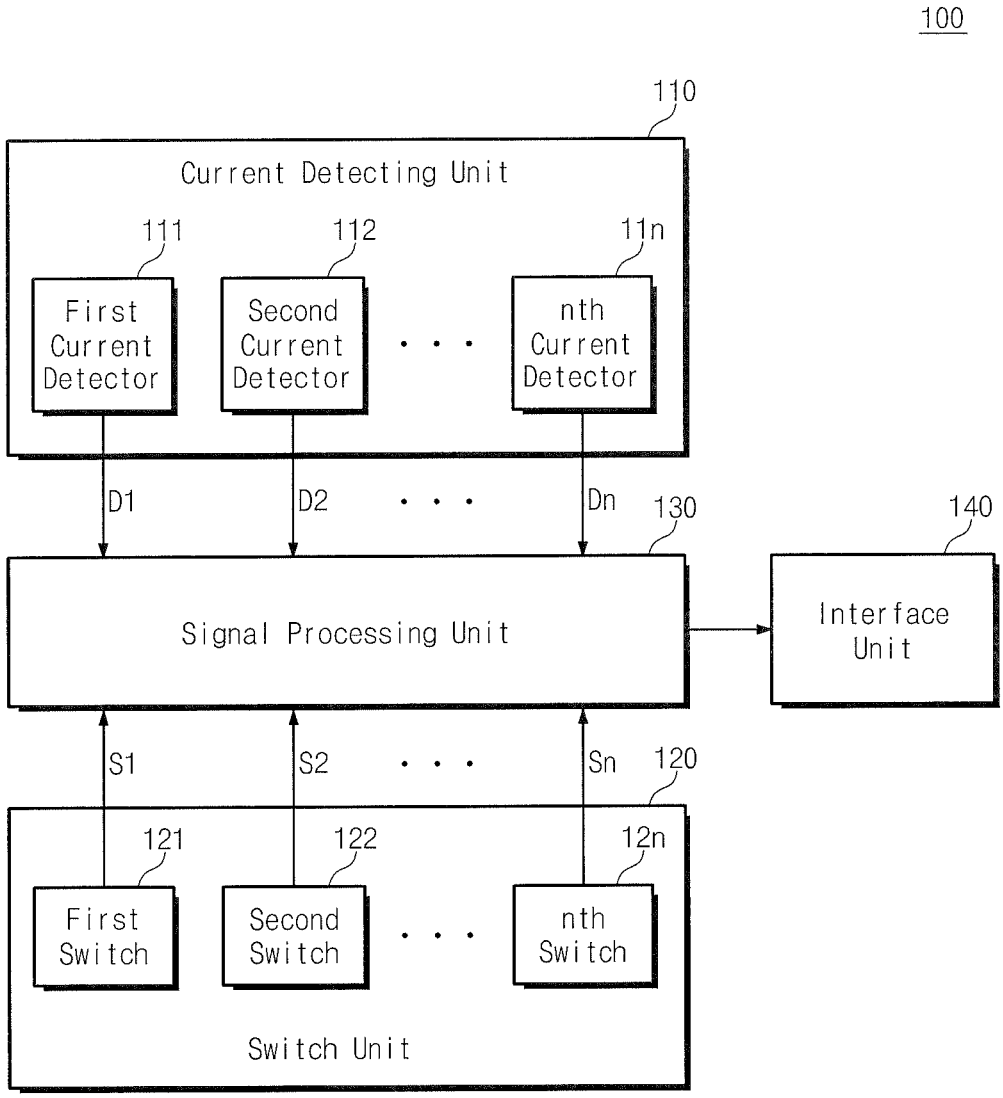
FIG. 1 is a block diagram illustrating a signal information transmitting device according to a first embodiment of the present invention.

FIG. 1 is a block diagram illustrating a signal information transmitting device according to a first embodiment of the present invention. Referring to FIG. 1, the signal information transmitting device 100 includes a current detecting unit 110, a switch unit 120, a signal processing unit 130, and an interface unit 140.

The current detecting unit 110 includes first to nth current detectors 111 to 11*n*. Each of the first to nth current detectors 111 to 11*n* may detect whether current flows through a target signal line or not.

For example, each of the first to nth current detectors 111 to 11*n* detects whether current flows through the target signal line or not, that is, a signal is delivered or not. Each of the first to nth current detectors 111 to 11*n* may be connected to signal lines of the target device in addition to the signal information transmitting device 100. The first to nth current detectors 111 to 11*n* may detect whether signals are transmitted through the signal lines of the target device. The first to nth current detectors 111 to 11*n* may be connected to respectively different signal lines.

According to a detection result, the first to nth current detectors 111 to 11*n* output first to nth detect signals D1 to Dn. When current is detected, the first to nth current detectors 111 to 11*n* may activate the first to nth detect signals D1 to Dn. When no current is detected, the first to nth current detectors 111 to 11*n* may deactivate the first to nth detect signals D1 to Dn. The first to nth current detectors 111 to 11*n* may output the first to nth detect signals D1 to Dn, which may be activated or deactivated at respectively different timings.

The switch unit 120 includes first to nth switches 121 to 12*n*. According to turning on or off of the first to nth switches 121 to 12*n*, they output first to nth switch signals S1 to Sn. When turned on, the first to nth switches 121 to 12*n* may deactivate the first to nth switch signals S1 to Sn. When turned off, the first to nth switches 121 to 12*n* may activate the first to nth switch signals S1 to Sn. The first to nth switches 121 to 12*n* may be turned on or off at respectively different timings. That is, the first to nth switches 121 to 12*n* may output the first to nth switch signals S1 to Sn, which are activated or deactivated at respectively different timings.

The signal processing unit 130 receives the detect signals D1 to Dn from the current detecting unit 110 and receives the switch signals S1 to Sn from the switch unit 120. The signal processing unit 130 may operate in a learning mode or an operating mode.

In the learning mode, the signal processing unit 130 may map the detect signals D1 to Dn with the switch signals S1 to Sn. For example, the signal processing unit may map the detect signals D1 to Dn with the switch signals S1 to Sn according to active sections of the detect signal D1 to Dn and active sections of the switch signals S1 to Sn. The signal processing unit 130 may map a switch signal with a specific detect signal. The mapped switch signal has the longest overlapping active section with an active section of the specific detect signal among the switch signals S1 to Sn.

In the operating mode, the signal processing unit 130 may transmit signal information on the detect signals D1 to Dn. For example, the signal processing unit 130 may transmit the signal information through the interface unit 140. The transmitted signal information may include information on a detect signal mapped with the specific switch signal. The transmitted signal information may include information regarding active and inactive sections of the detect signals D1 to Dn.

The interface unit 140 may include a communication module for transmitting information wirelessly, a display module for transmitting information through images or a sound module for transmitting information through sound.

Figure 2:
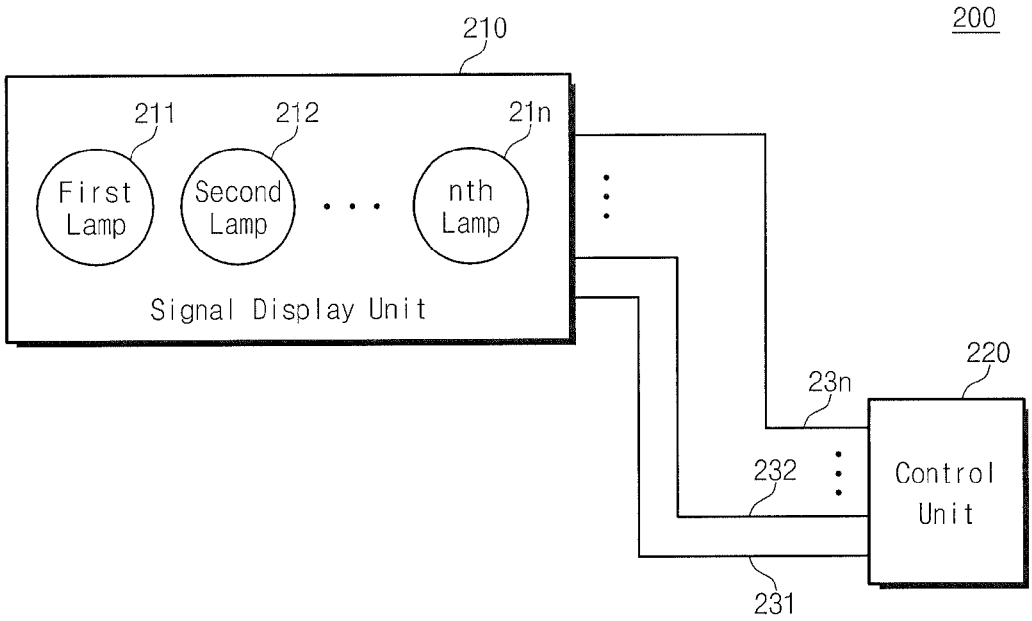
FIG. 2 is a block diagram illustrating a target device connected to the signal information transmitting device of FIG. 1 according to an embodiment of the present invention.

FIG. 2 is a block diagram illustrating a target device connected to the signal information transmitting device 100 of FIG. 1 according to an embodiment of the present invention. Referring to FIG. 2, the target device 200 includes a signal display unit 210 and a control unit 220. The signal display unit 210 may include first to nth lamps. The control unit 220 may turn on or off the first to nth lamps 211 to 21*n* through first to nth signal lines 231 to 23*n*. Exemplarily, the target device 200 may be a traffic light. The first to nth lamps 211 to 21*n* may include a stop signal, a go straight signal, a left turn signal, a warning signal, and a changeable lane signal. The first to nth signal lines 231 to 23*n* may supply power to the first to nth lamps 211 to 21*n*.

Figure 3:
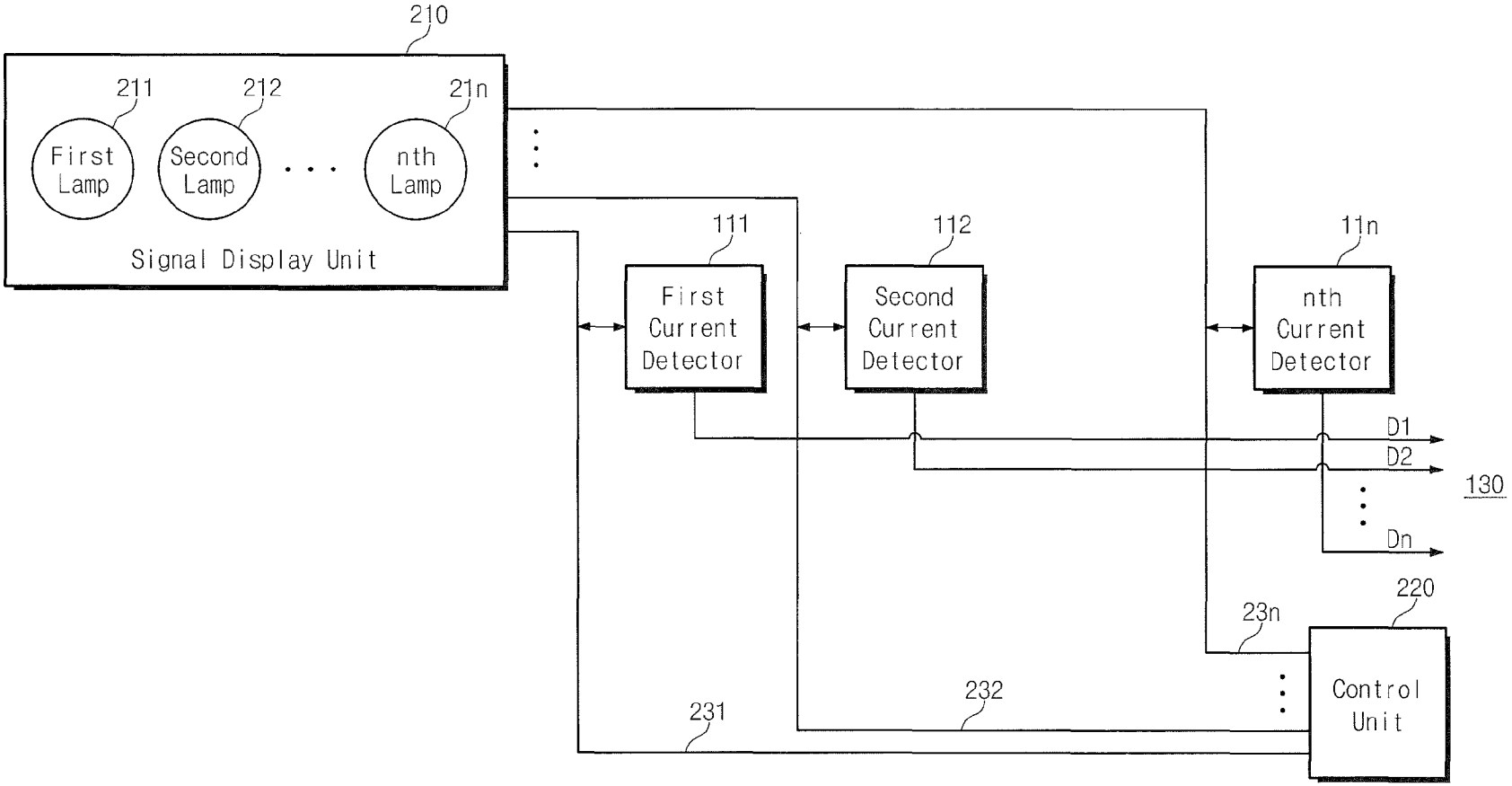
FIG. 3 is a block diagram when the first to nth current detectors are connected to the target device of FIG. 2 according to an embodiment of the present invention.

FIG. 3 is a block diagram when the first to nth current detectors 111 to 11*n* are connected to the target device 200 of FIG. 2 according to an embodiment of the present invention. Referring to FIG. 3, the first to nth current detectors 111 to 11*n* may be connected to the first to nth signal lines 231 to 23*n*, respectively. When current flows through the first to nth signals 231 to 23*n*, the first to nth current detectors 111 to 11*n* may activate the first to nth detect signals D1 to Dn. That is, the signal information transmitting device 100 may determine whether current flows through signal lines for controlling lamps of a traffic light.

Figure 4:
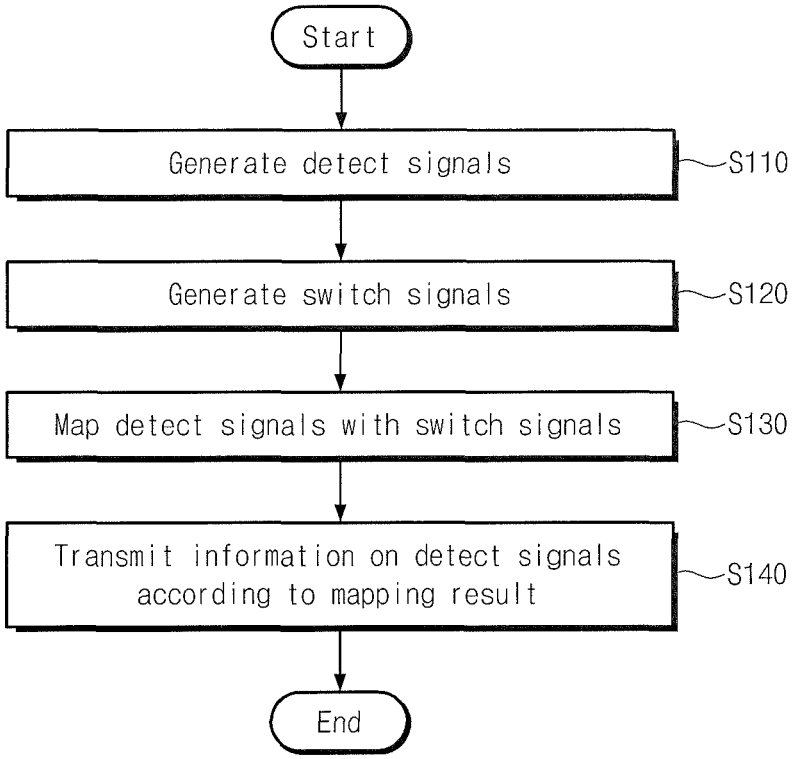
FIG. 4 is a flowchart illustrating a method of transmitting signal information according to an embodiment of the present invention.

FIG. 4 is a flowchart illustrating a method of transmitting signal information according to an embodiment of the present invention. Referring to FIGS. 1, 3, and 4, the detect signals D1 to Dn are generated in operation S110. That is, it is determined whether current flows through the signal lines 231 to 23*n* connected to the first to nth current detectors 111 to 11*n*.

Each of the first to nth lamps 221 to 21*n* of the traffic light has a light-on section and a light-out section. When power is applied to a specific lamp, current flows through a signal line connected to the specific lamp. That is, the specific lamp is turned on, a current detector connected to the specific lamp through a signal line may activate a detect signal. When no power is applied to the specific lamp, no current flows through a signal line connected to the specific lamp. That is, when the specific lamp is turned off, a current detector connected to the specific lamp through a signal line may deactivate a detect signal.

In operation S120, switch signals S1 to Sn are generated. That is, it is determined whether the first to nth switches 121 to 12*n* are turned on or off.

Exemplarily, the first to nth switches 121 to 12*n* may be respectively allocated to the first to nth lamps 211 to 21*n* of the target device 200. When a specific lamp of the signal display unit 210 is turned on, a switch allocated to the specific lamp among the first to nth switches 121 to 12*n* may be closed.

For example, a user may turn on a switch allocated to a specific lamp when the specific lamp of the signal display unit 210 is turned on. That is, when the specific lamp is turned on, a switch signal of the switch allocated to the specific lamp is activated. When a red lamp is turned on, a user may turn on a switch allocated to the red lamp. That is, when the red lamp is turned on, the switch allocated to the red lamp may be activated. When a green lamp is turned on, a user may turn on a switch allocated to the green lamp. That is, when the green lamp is turned on, the switch allocated to the green lamp may be activated.

As another example, an image sensor (not shown) may be additionally connected to the signal information transmitting device 100. The first to nth switches 121 to 12*n* may be controlled according to an output of the image sensor. The image sensor may output signals for controlling the first to nth switches 121 to 12*n* according to a color of an obtained image and a position of a turned on lamp in the obtained image.

In operation S130, the detect signals D1 to Dn and the switch signals S1 to Sn are mapped to each other. As described in operation S110, when current flows through a specific signal line, a current detector connected to the specific signal line activates a detect signal. As described in operation S120, when a specific lamp is turned on, a switch corresponding to the specific lamp activates a switch signal.

The signal processing unit 130 may map the detect signals D1 to Dn with the switch signals S1 to Sn. The signal processing unit 130 may map the detect signals D1 to Dn with the switch signals S1 to Sn according to active sections of the detect signals D1 to Dn and active sections of the switch signals S1 to Sn. The signal processing unit 130 may map a switch signal with a specific detect signal. The switch signal has the longest overlapping active section with an active section of the specific detect signal, In operations S110 to S130, in relation to the learning mode, the signal information transmitting device 100 maps the detect signals D1 to Dn with the switch signals S1 to Sn. In relation to the learning mode, the signal processing unit 130 may map the detect signals D1 to Dn with the switch signals S1 to Sn according to active sections of the detect signals D1 to Dn and active sections of the switch signals S1 to Sn. Since the switches 121 to 12*n* generating the switch signals S1 to Sn are allocated to the lamps 211 to 21*n*, respectively, the detect signals D1 to Dn corresponding to the respective lamps 211 to 21*n* may be determined according to a mapping result. That is, the first to nth lamps 211 to 21*n* controlled through the first to nth signal lines 231 to 23*n* may be determined.

For example, the signal processing unit 130 may map the first detect signal D1 with the k switch signal Sk. The k switch 12*k* generating the k switch signal Sk may be a lamp allocated to a green lamp. At this point, it is determined that the signal processing unit 130 controls the green lamp through a signal line to which the first detect signal D1 is supplied.

That is, in relation to the learning mode in operations S110 to S130, the signal processing unit 130 maps the first to nth detect signals D1 to Dn with the first to nth switch signals S1 to Sn and determines which lamps correspond to the respective first to nth detect signals D1 to Dn.

The lamps of a traffic light are turned on and off periodically. That is, each of the first to nth detect signals D1 to Dn may be periodically activated or deactivated. During the learning mode in operations S110 to S130, the signal processing unit 130 may detect periods for which the first to nth detect signals D1 to Dn are activated or deactivated and the length of an active section. For example, when the k detect signal Dk is activated again in a time A after activated, it is determined that a period for which the k detect signal Dk is activated is the time A. After the k detect signal Dk is activated and then deactivated in a time B, the length of the active section for the k detect signal Dk may be determined as the time B.

In operation S140, according to a mapping result, information on the detect signals D1 to Dn is transmitted. In operation S140, in relation to the operating mode, the signal information transmitting device 100 transmits the information on the detect signals D1 to Dn on the basis of a mapping relation between the detect signals D1 to Dn and the switch signals S1 to Sn.

Exemplarily, the signal processing unit 130 may transmit information regarding a time of when a detect signal mapped with a specific switch signal among the detect signals D1 to Dn is activated or deactivated next time. A specific switch signal may be an output signal of a switch allocated to a specific lamp of a traffic light. The signal processing unit 130 may transmit information regarding a time of when start signals such as a go straight signal and a turn left signal of the traffic light are activated or deactivated next time. The signal processing unit 130 may transmit information regarding a time of when a stop signal of the traffic light is deactivated or activated next time. The information regarding a time of when a specific lamp of the traffic light is deactivated or activated next time may be obtained from a period for which a detect signal corresponding to the specific lamp is activated or deactivated and the length of an active section.

The signal processing unit 130 may transmit information such as a remaining time until the lamp of the start signal is turned on, a time of when the lamp of the start signal is turned on next time, a remaining time until the lamp of the start signal is turned off, and a time of when the lamp of the start signal is turned off next time. The signal processing unit 130 may transmit information such as a remaining time until the lamp of the stop signal is turned on, a time of when the lamp of the stop signal is turned on next time, a remaining time until the lamp of the stop signal is turned off, and a time of when the lamp of the stop signal is turned off next time.

Figure 5:
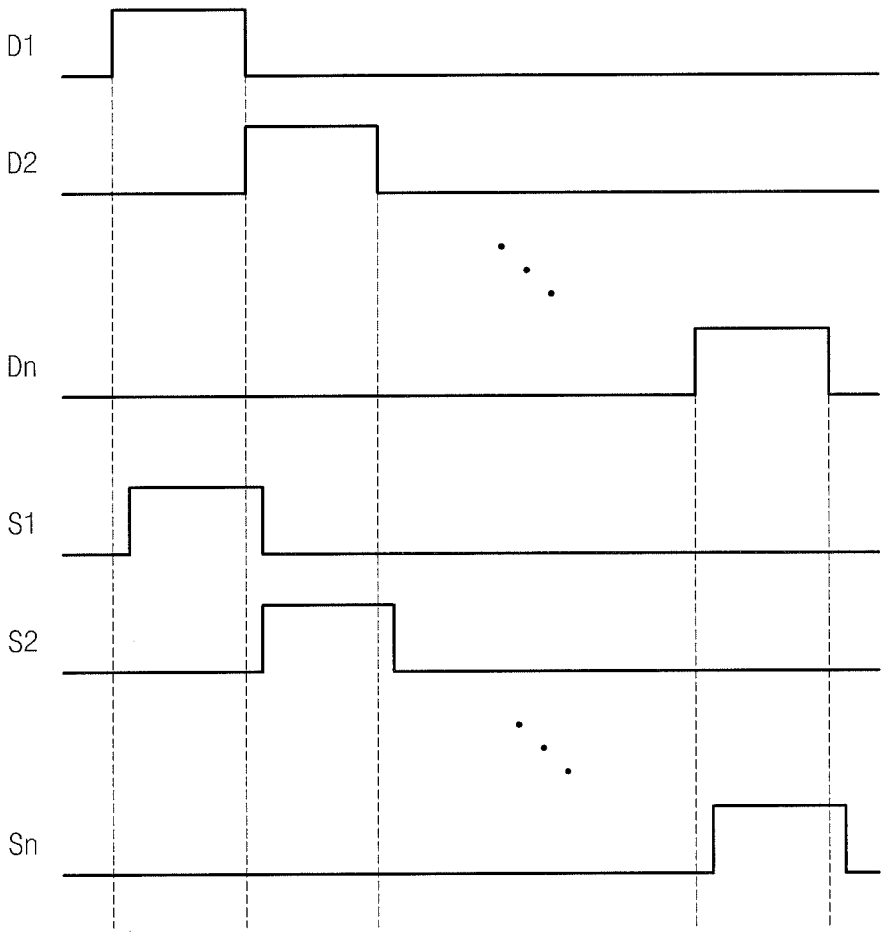
FIG. 5 is a timing diagram illustrating a method of mapping the detect signals with the switch signals, respectively, according to an embodiment of the present invention.

FIG. 5 is a timing diagram illustrating a method of mapping the detect signals D1 to Dn with the switch signals S1 to Sn, respectively, according to an embodiment of the present invention. Referring to FIGS. 1 to 5, when the first detect signal D1 is activated, the first switch signal S1 is activated. The signal processing unit 130 may map the first detect signal D1 with the first switch signal S1.

When the second detect signal D2 is activated, the first switch signal S1 and the second switch signal S2 are activated. The signal processing unit 130 may map the second switch signal S2 with the second detect signal D2. The switch signal S2 has the longest overlapping active section with the active section of the second detect signal D2.

When the nth detect signal Dn is activated, the nth switch signal Sn is activated. The signal processing unit 130 may map the nth detect signal Dn with the nth switch signal Sn.

When an active section of one switch signal overlaps active sections of detect signals, a detect signal having the longest overlapping active section may be mapped with the switch signal. When an active section of one detect signal overlaps active sections of switch signals, a switch signal having the longest overlapping active section may be mapped with the detect signal.

Figure 6:
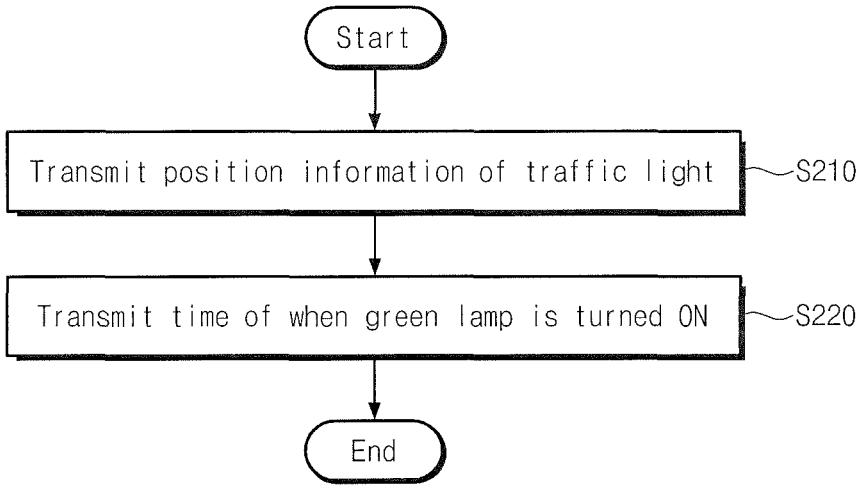
FIG. 6 is a flowchart illustrating a method of a signal information transmitting device to transmit signal information according to an embodiment of the present invention.

FIG. 6 is a flowchart illustrating a method of a signal information transmitting device 100 to transmit signal information according to an embodiment of the present invention. Referring to FIGS. 1 and 6, the position information on the traffic light is transmitted in operation S210. For example, the signal information transmitting device 100 may transmit information regarding the installed position of the signal information transmitting device 100. The signal information transmitting device 100 may transmit the position information to the target device 200 connected to the signal information transmitting device 100, for example, the position information on the traffic light.

In operation S220, the signal information transmitting device 100 may transmit information regarding a time of when the green lamp is turned on.

The signal information transmitting device 100 may repeat operations S210 and S220.

Figure 7:
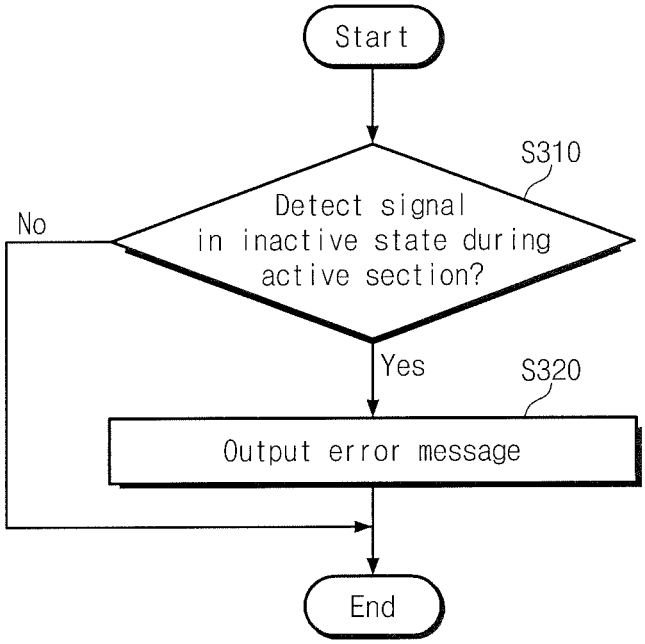
FIG. 7 is a flowchart illustrating a method of the signal information transmitting device to process an error according to an embodiment of the present invention.

FIG. 7 is a flowchart illustrating a method of the signal information transmitting device 100 to process an error according to an embodiment of the present invention. Referring to FIGS. 1 and 7, it is determined in operation S310 whether a specific detect signal is in a deactivated state during an active section. Exemplarily, the signal information transmitting device 100 may determine whether a detect signal corresponding to a specific lamp is in a deactivated state or not during an active section for which the specific lamp should be turned on. If the detect signal corresponding to the specific lamp is in a deactivated state, the specific lamp is not turned on. Accordingly, in operation S320, the signal information transmitting device 100 outputs an error message indicating that the specific lamp is not turned on during an active section for which the specific lamp should be turned on. This error message may be transmitted to a control center (not shown) through a wire or wireless network. When the error message is outputted, the signal information transmitting device 100 may stop transmitting signal information.

Figure 8:
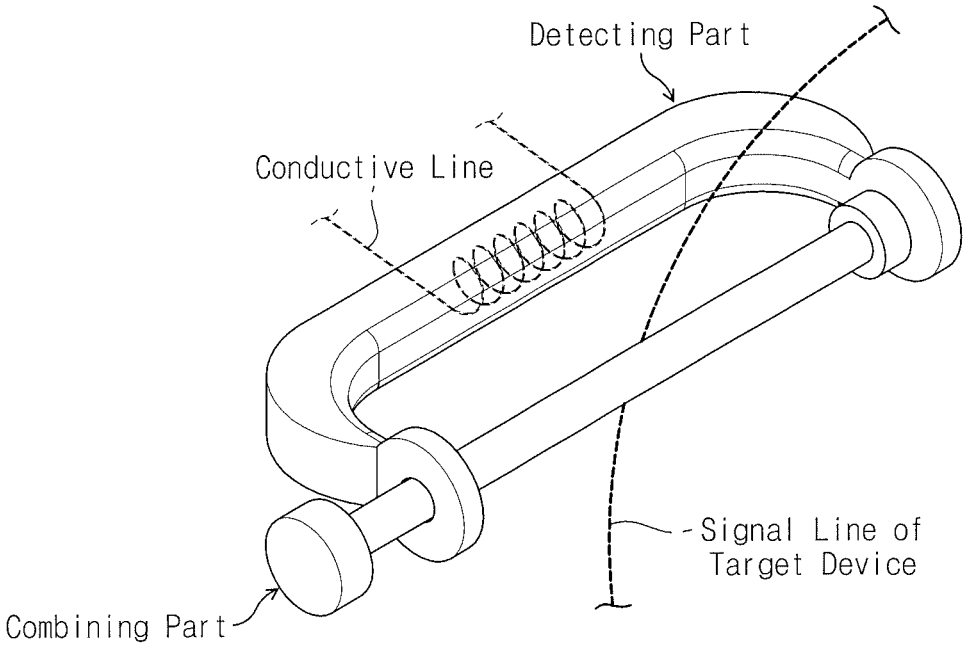
FIG. 8 is a view illustrating one of the first to nth current detectors according to a first embodiment of the present invention.

FIG. 8 is a view illustrating one of the first to nth current detectors 111 to 11*n* according to a first embodiment of the present invention. Referring to FIG. 8, the current detector 11*k* includes a combining part and a detecting part. The combining part combines the current detector 11*k* with a signal line of the target device 200. The current detector 11*k* may surround or may be combined with the signal line of the target device 200.

The detecting part detects a current flowing through the combined signal line. The detecting part may include a conductive line wound several times around it. When current flows through the signal line of the target device 200, another current may flow through the conductive line due to electromagnetic induction. According to whether current flows through the conductive line, the current detector 11*k* may detect whether current flows through the signal line of the target device 200.

Figure 9:
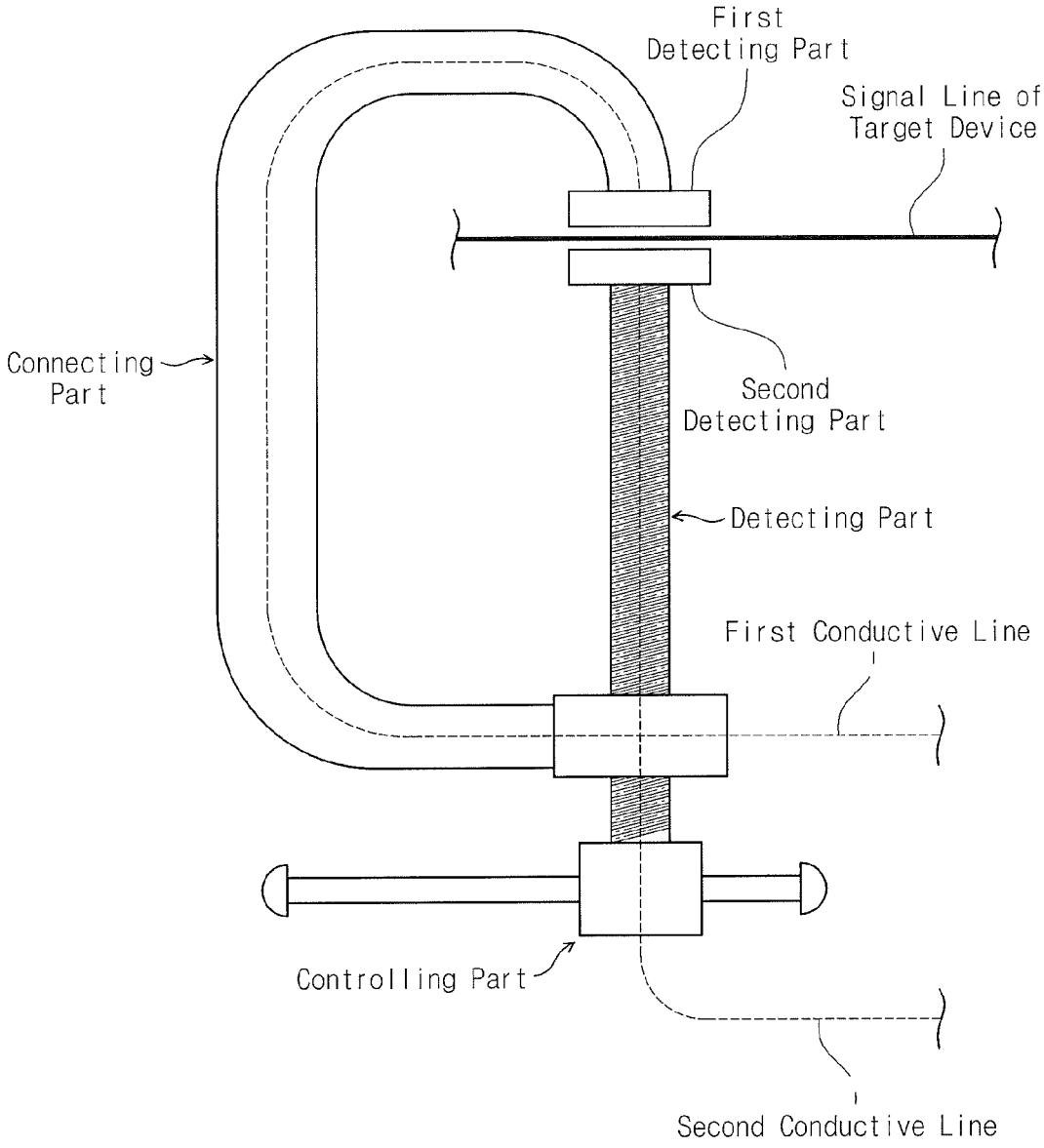
FIG. 9 is a view illustrating one of the first to nth current detectors according to a second embodiment of the present invention.

FIG. 9 is a view illustrating one of the first to nth current detectors 111 to 11*n* according to a second embodiment of the present invention. Referring to FIG. 9, the current detector 11*k* includes a first detecting part, a second detecting part, a connecting part, and a combining part, and a controlling part.

The connecting part connects the first detecting unit, the combining part, and the controlling part. The controlling part adjusts a position of the combining part. The combining part combines the current detector 11*k* (in detail, the first detecting part and the second detecting part of the current detecting unit 11*k*) with a signal line of the target device 200. Exemplarily, the first detecting part and the second detecting part may engage with the signal line of the target device 200 therebetween. The distance between the first detecting part and the second detecting part may be adjusted according to a control of the controlling part. The first detecting part may be fixed at the connecting part. The second detecting part may be fixed at the combining part and the combining part may have a screw structure. The controlling part may be combined with the head of the screw structure of the combining part.

The first detecting part and the second detecting part may include a conductive material. The first detecting part may be connected to a first conductive line. The first conductive line may be connected to the first detecting part through the inside of the connecting part. The second detecting part may be connected to a second conductive line. The second conductive line may be connected to the second detecting part through the inside of the control part and the combining part. When current flows through the signal line of the target device 200, potential difference may occur in the first and second detecting parts due to electromagnetic induction. Due to the potential difference of the first and second detecting parts, current may flow through the first and second conductive lines. The current detector 11*k* may detect whether current flows through the signal line of the target device 200 according to the flowing current in the first and second conductive lines.

Figure 10:
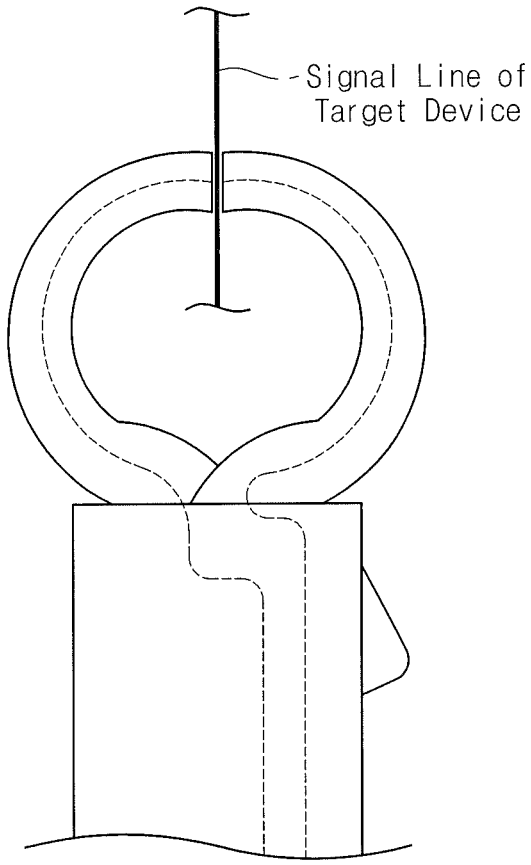
FIG. 10 is a view illustrating one of the first to nth current detectors according to an embodiment of the present invention.

FIG. 10 is a view illustrating one of the first to nth current detectors 111 to 11*n* according to an embodiment of the present invention. Referring to FIG. 10, the current detector 11*k* may have a clamp structure like a current clamp meter.

Figure 11:
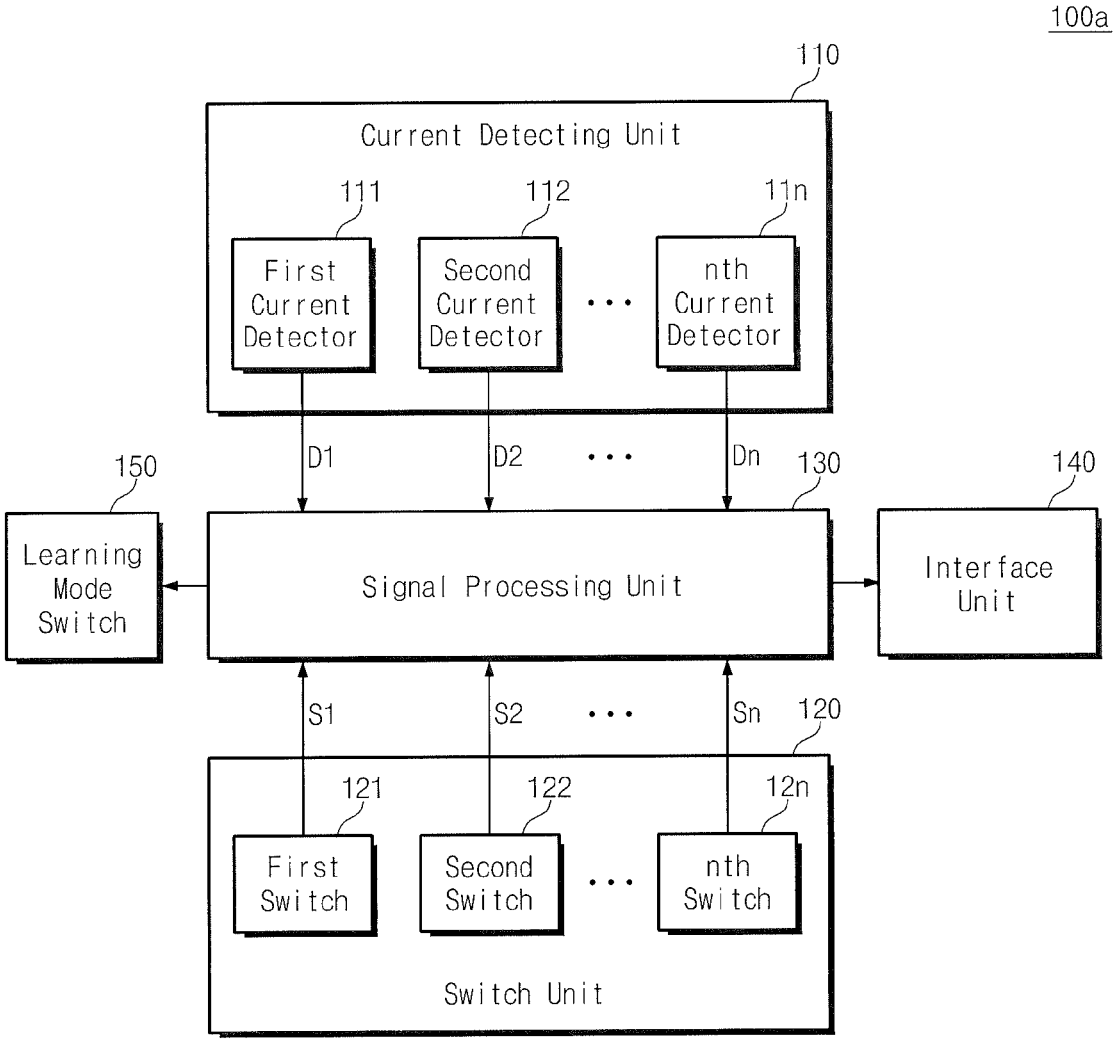
FIG. 11 is a block diagram illustrating a signal information transmitting device according to a second embodiment.

FIG. 11 is a block diagram illustrating a signal information transmitting device 100*a* according to a second embodiment. As compared to the signal information transmitting device 100 of FIG. 1, the signal information transmitting device 100*a* may further include a learning mode switch 150.

As described with reference to FIG. 4, the signal information transmitting device 100 may have the learning mode and the operating mode. The learning mode and the operating mode of the signal information transmitting device 100*a* may be controlled by controlling the learning mode switch 150.

Once the learning mode operates by the learning mode switch 150, the signal processing unit 130 may map the detect signals D1 to Dn with the switch signals S1 to Sn. In the learning mode, the signal processing unit 130 may detect periods for which the detection signals D1 to Dn are activated or deactivated and active sections.

Once the operating mode operates by the learning mode switch 150, the signal processing unit 130 may transmit information on the detect signals D1 to Dn. In the operating mode, the signal processing unit 130 may ignore the switch signals S1 to Sn. In the operating mode, the signal processing unit 130 may stop detecting periods for which the detect signals D1 to Dn are activated or deactivated and active sections.

As the learning mode repeats, the detect signals D1 to Dn and the switch signals S1 to Sn are repeatedly mapped and the periods for which the detect signals D1 to Dn are activated or deactivated and the active sections are repeatedly detected. As mapping information and information regarding the periods for which the detect signals D1 to Dn are activated or deactivated and the active sections are repeatedly accumulated, reliability may be improved. When a time for the learning mode is controlled through the learning mode switch 150, reliability of the signal information transmitting device 100*a* may be improved.

Once the signal information transmitting device 100*a* operates in the operating mode, the switch signals S1 to Sn are ignored. Accordingly, mapping information disturbance due to malfunctions of the switches 121 to 12*n* may be prevented in the operating mode.

Figure 12:
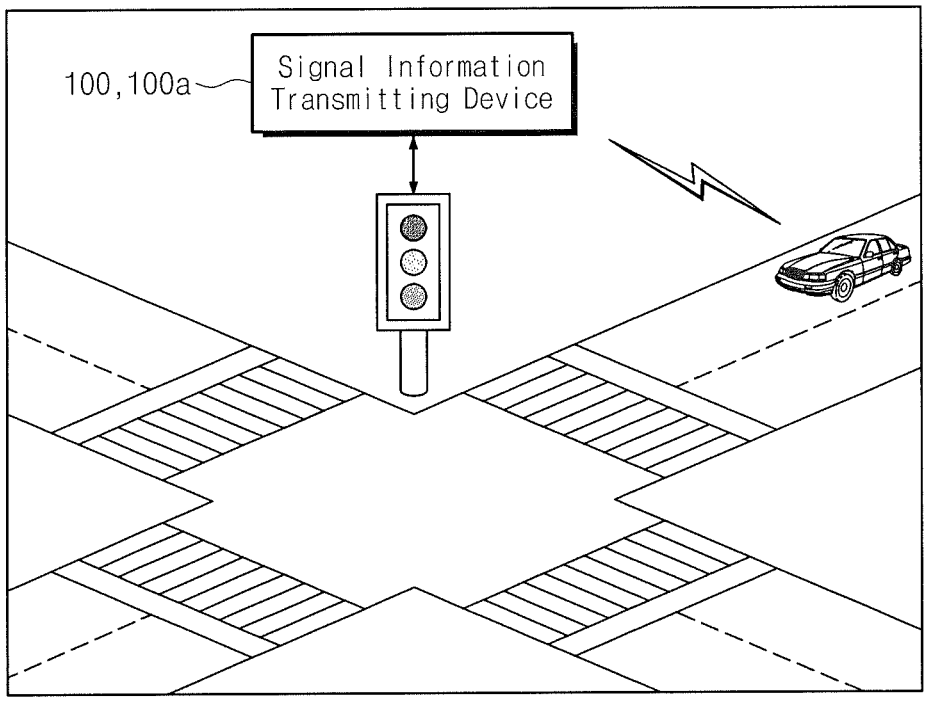
FIG. 12 is a view when the signal information transmitting devices according to the embodiments of the present invention are applied to a traffic system.

FIG. 12 is a view when the signal information transmitting devices 100 and 100*a* according to the embodiments of the present invention are applied to a traffic system. A crossroad, a traffic light, the signal information transmitting devices 100 and 100*a* connected to the traffic light, and a car are shown in FIG. 12.

In the learning mode, the signal information transmitting devices 100 and 100*a* may obtain information regarding signals of the traffic light. In the operating mode, the signal information transmitting devices 100 and 100*a* may transmit signal information on the traffic light. Exemplarily, the signal information transmitting devices 100 and 100*a* may transmit signal information such as a time of when a green lamp in the traffic light is turned on, a time until the green lamp is turned on, a time of when a left turn (or right turn) lamp is turned on, and a time until the left turn (or right turn) lamp is turned on.

The car receives the signal information from the signal information transmitting devices 100 and 100*a*. When a red lamp of the traffic light is turned on and a driver wants to go straight, the car may stop the engine if a time until the green lamp of the traffic light is turned on is more than or equal to a first reference value. When the time until the green lamp of the traffic light is turned on becomes less than a second reference value, the car may start the engine again. When the red lamp of the traffic light is turned on, the driver wants to go straight, and a time until the green lamp of the traffic signal is turned on is less than the first reference value, the car may maintain the running motor. The first reference value is greater than the second reference value.

When the red lamp of the traffic light is turned on, a driver wants to make a left turn (or right turn), and a time until a left turn (or right turn) lamp of the traffic light is turned on is more than or equal to the first reference value, the car may stop the engine. When the time until the left turn (or right turn) lamp of the traffic light is turned on is less than the second reference value, the car may start the engine again. When the red lamp of the traffic light is turned on, the driver want to make a left turn (or right turn) and a time of when the left turn (or right turn) lamp of the traffic light is turned on is less than the first reference value, the car may maintain a running engine. The first reference value is greater than the second reference value.

According to the present invention, a signal information transmitting device with reduced costs and less complexity and a signal information transmitting method for transmitting signal information through signals of a traffic light may be provided.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A signal information transmitting method, comprising:

detecting sections for which current flows through signal lines of a target device and generating detect signals according to the current flow detection result;

detecting sections for which switches are turned on and generating switch signals according to the switch detection result;

mapping the detect signals with the switch signals according to overlapping sections between active sections of the detect signals and active sections of the switch signals; and transmitting information on the detect signals according to the mapping result.

2. The signal information transmitting method of claim 1, wherein the mapping of the detect signals with the switch signals comprises mapping a switch signal with a specific detect signal in response to switch signals generated during a learning mode, the switch signal having the longest overlapping active section with an active section of the specific detect signal.

3. The signal information transmitting method of claim 1, wherein the transmitting of the detect signals comprises transmitting information regarding an active section of a detect signal mapped with a specific switch signal.

4. The signal information transmitting method of claim 3, wherein the transmitting of the information on the detect signals comprises transmitting an error message when the mapped detect signal is not activated during an active section thereof.

5. The signal information transmitting method of claim 1, further comprising transmitting position information.

6. The signal information transmitting method of claim 1, wherein the target device comprises a traffic light.

7. The signal information transmitting method of claim 6, wherein the signal lines are control lines controlling lamps of the traffic light.

8. A signal information transmitting device comprising:

a plurality of current detectors configured to activate detect signals according to whether current is detected or not;

a plurality of switches configured to activate switch signals when turned on; and a signal processing unit configured to map the detect signals with the switch signals during a learning mode, wherein the signal processing unit transmits information on the detect signals according to the mapping result during an operating mode.

9. The signal information transmitting device of claim 8, wherein the signal processing unit maps a switch signal with a specific detect signal during the learning mode, the switching signal having the longest overlapping active section with an active section of the specific detect signal.

10. The signal information transmitting device of claim 8, wherein the signal processing unit transmits information regarding an active section of a detect signal mapped with the specific switch signal during the operating mode.

11. The signal information transmitting device of claim 10, wherein the signal processing unit outputs an error message when the mapped detect signal is not activated in an active section thereof during the operating mode.

12. The signal information transmitting device of claim 8, wherein the signal processing unit further transmits position information during the operating mode.

* * * * *